US006824502B1

(12) United States Patent
Huang

(10) Patent No.: US 6,824,502 B1
(45) Date of Patent: Nov. 30, 2004

(54) BODY TEMPERATURE ACTUATED TREADMILL OPERATION MODE CONTROL ARRANGEMENT

(76) Inventor: Ping-Hui Huang, No. 23, 15th Road, Ta Li Industrial Park, Taiping City, Taichung Hsien (TW)

( * ) Notice: Subject to any disclaimer, the term of this patent is extended or adjusted under 35 U.S.C. 154(b) by 0 days.

(21) Appl. No.: 10/653,108

(22) Filed: Sep. 3, 2003

(51) Int. Cl.[7] ..... A63B 22/00
(52) U.S. Cl. ..... 482/54; 482/9
(58) Field of Search ..... 482/51–57, 1–9

(56) References Cited

U.S. PATENT DOCUMENTS 5,368,532 A * 11/1994 Farnet ..... 482/5
6,450,925 B1 * 9/2002 Kuo ..... 482/52
6,454,682 B1 * 9/2002 Kuo ..... 482/52
6,620,079 B2 * 9/2003 Kuo ..... 482/51

* cited by examiner

*Primary Examiner*—Stephen R. Crow
(74) *Attorney, Agent, or Firm*—Rosenberg, Klein & Lee

(57) ABSTRACT

A body temperature actuated treadmill operation mode control arrangement is constructed to include two body temperature movement detection circuits respectively formed of a pyroelectric effect sensor, a resistor, and a capacitor, and adapted to detect the presence of the moving left hand or right hand of the user, a signal amplifier adapted to amplify the output signal of each body temperature movement detection circuit, and a microprocessor adapted to control the speed of the walking belt control motor and the forward/backward rotation of the tilting control motor of the treadmill subject to the output signal from the right body temperature movement detection circuits.

3 Claims, 6 Drawing Sheets

BODY TEMPERATURE ACTUATED TREADMILL OPERATION MODE CONTROL ARRANGEMENT

BACKGROUND OF THE INVENTION

1. Field of the Invention

The present invention relates to treadmills and, more particularly, to a body temperature actuated treadmill operation mode control arrangement.

2. Description of the Related Art

Various treadmills have been disclosed, and have appeared on the market. A treadmill is generally comprised of a tread base, a front upright frame upwardly extended from the tread base near the front side, a console installed at the top of the upright frame and used to control the treadmill's operation, a walking belt installed at the tread base, and a motor disposed at the bottom side of the upright frame to drive the walking belt in rotation. When adjusting the speed during exercise, the user must move forwards toward the console, and then operate the control buttons of the console to set the desired speed. It is dangerous to change the speed when walking or running on the walking belt of the treadmill. There are treadmills equipped an infrared sensor actuated control circuit for controlling the speed of rotation of the walking belt. However, this design of infrared sensor actuated control circuit is not highly reliable because it cannot eliminate the interference of ambient light (the sunlight or the light of a lamp).

Further, a treadmill may be provided with a tilting control motor adapted to control the tilting angle of the tread base (walking belt). When adjusting the tilting angle of the tread base, the user must stop exercises, and then adjust the mechanism (or operate the console to achieve the adjustment). This adjustment procedure is still inconvenient.

SUMMARY OF THE INVENTION

The present invention has been accomplished under the circumstances in view. It is the main object of the present invention to provide a body temperature actuated treadmill operation mode control arrangement, which enables the user to adjust the speed and/or tilting angle of the treadmill by moving the left or right hand when exercising.

According to one embodiment of the present invention, the body temperature actuated treadmill operation mode control arrangement is used in a treadmill having a motor disposed at the bottom end of an upright frame to drive a walking belt in rotation and left, right handlebars disposed at the upright frame, and a console located on the top of the upright frame and used to control the treadmill's operation and to show numerical values and drawings with respect to the exercise state, the body temperature actuated treadmill operation mode control arrangement comprising a left body temperature movement detection circuit adapted to detect movement of the user's left hand to produce a corresponding signal output, the left body temperature movement detection circuit being formed of a left pyroelectric effect sensor, a resistor, and a capacitor, the left pyroelectric effect sensor being installed at the respectively disposed at the left handlebar of the treadmill; a right body temperature movement detection circuit adapted to detect movement of the user's right hand to produce a corresponding signal output, the right body temperature movement detection circuit being formed of a right pyroelectric effect sensor, a resistor, and a capacitor, the right pyroelectric effect sensor being installed at the respectively disposed at the right handlebar of the treadmill; signal amplifier means adapted to amplify the output signal of the left body temperature movement detection circuit and the output signal of the right body temperature movement detection circuit; and a microprocessor electrically coupled between the signal amplifier means and the console of the treadmill and adapted to control the operation speed of the motor of the treadmill subject to the output signal from the right body temperature movement detection circuit and the output signal from the left body temperature movement detection circuit. In an alternate form of the present invention, the body temperature actuated treadmill operation mode control arrangement is adapted to control forward/backward rotation of the tilting control motor and to further control the tilting angle of the walking belt of the treadmill. In another alternate form, the body temperature actuated treadmill operation mode control arrangement is adapted to control the speed of the walking belt control motor and the direction of rotation of the tilting control motor.

DETAILED DESCRIPTION OF THE PREFERRED EMBODIMENT

Figure 1:
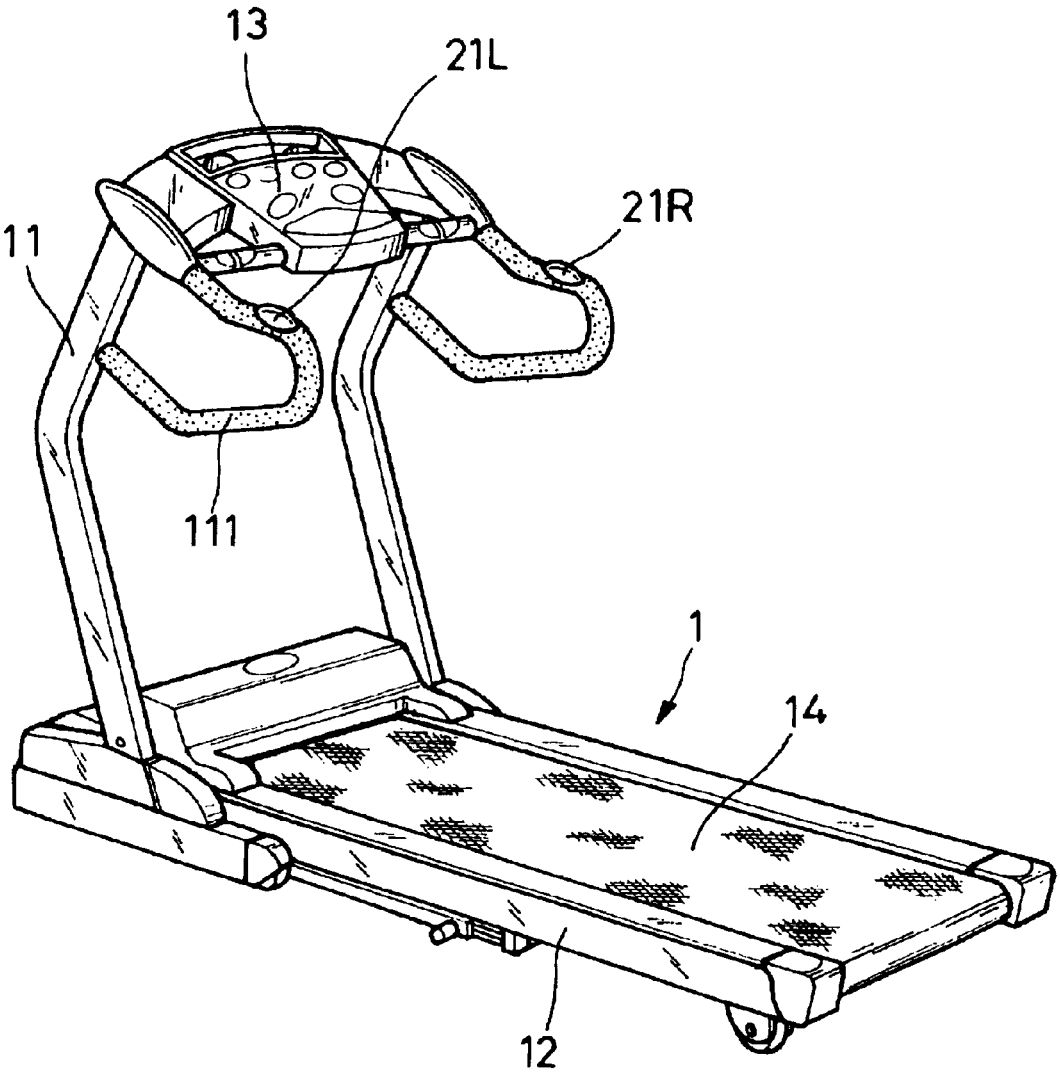
FIG. 1 is an elevational view of a treadmill according to the present invention.
Figure 2:
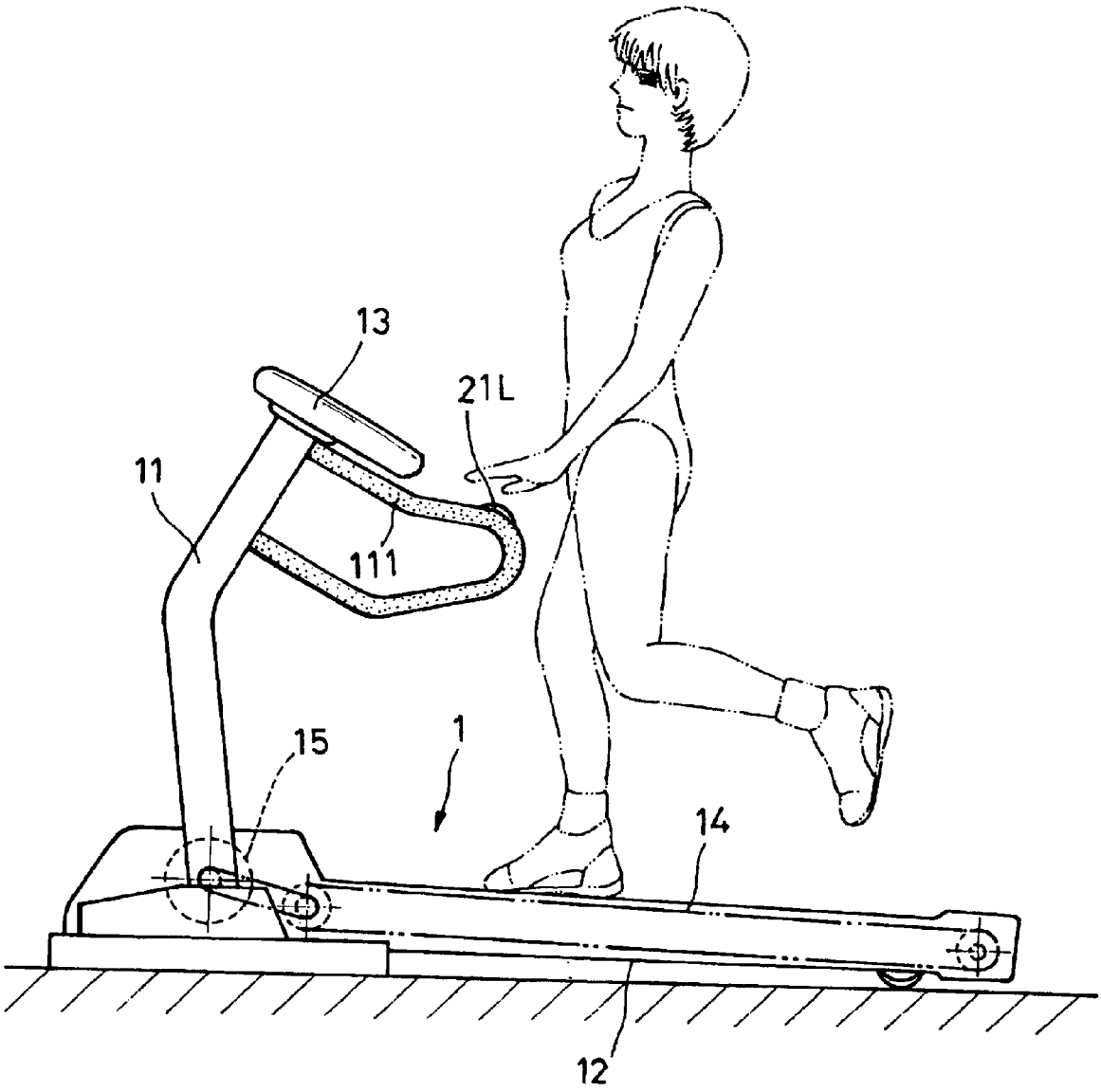
FIG. 2 is a schematic drawing showing a walking belt rotation speed adjustment example according to the present invention.

Referring to FIGS. 1~5, a treadmill 1 is shown comprising a tread base 12, a front upright frame 11 upwardly extended from the tread base 12 near the front side, a console 13 installed at the top of the upright frame 11 and used to control the treadmill's operation, a walking belt 14 installed at the tread base 12, two handlebars 111 bilaterally disposed at the upright frame 11 near the console 13, and a motor 15 disposed at the bottom side of the upright frame 11 to drive the walking belt 14 in rotation.

Two pyroelectric effect sensors 21L and 21R are respectively disposed at the handlebars 111, and formed with a respective resistor R1 or R6 and a respective capacitor C1 or C2 a respective body temperature movement detection circuit 2L or 2R adapted to detect body temperature movement signal when the user moving the hand over the corresponding pyroelectric effect sensor 21L or 21R.

The left and right body temperature movement detection circuits 2L and 2R are set to detect positive and negative signals respectively, and respectively connected in series to a respective signal amplifier 3L or 3R and then a microprocessor 4 in the console 13. Upon receipt of positive or negative signal from the left body temperature movement detection circuit 2L or right body temperature movement detection circuit 2R, the microprocessor 4 controls the console 13 to change the output status of the motor 15.

Referring to FIG. 5 again, the signal amplifier 3L/3R and the microprocessor 4 form a control circuit 5 that can be installed at the same circuit board and mounted in the treadmill 1, for example, inside the console 13. The control circuit 5 is electrically coupled to the internal circuit of the console. Therefore, the operation status of the motor 15 can be controlled by the control buttons of the console 13. Alternatively, the operation status of the motor 15 can also be controlled by the body temperature movement detection circuit 2L or 2R and the corresponding control circuit 5.

Referring to FIGS. 2, 4, and 5 again, if the user wishes to accelerate or reduce the speed when running on the walking belt 14 of the treadmill 1, the user needs not to move forwards and then press the control buttons of the console 13, at this time the user can approach the left hand or right hand to the body temperature movement detection circuit 2L or 2R and move the hand without touching the body temperature movement detection circuit 2L or 2R, as shown in FIG. 4. According to this embodiment, the left hand is set to reduce the speed and the right hand set to accelerate the speed. When the user's right hand is approaching the body temperature movement detection circuit 2R, the pyroelectric effect sensor 21R picks up the signal. The signal thus obtained is then amplified by the signal amplifier 3R, thereby causing the microprocessor 4 to drive the console 13 to output an accelerating signal to the motor 15, and therefore the motor 15 accelerates the speed of rotation of the walking belt 14. At the same time, the console 13 shows numerical values and drawings with respect to the exercise state. When wishing to accelerate the speed further, the user can then move the right hand over the pyroelectric effect sensor 21R again. On the contrary, moving the left hand over the pyroelectric effect sensor 21L causes the motor 15 to reduce the speed. Therefore, the user can easily control the speed of the motor 15 when walking or running on the walking belt 14.

Figure 6:
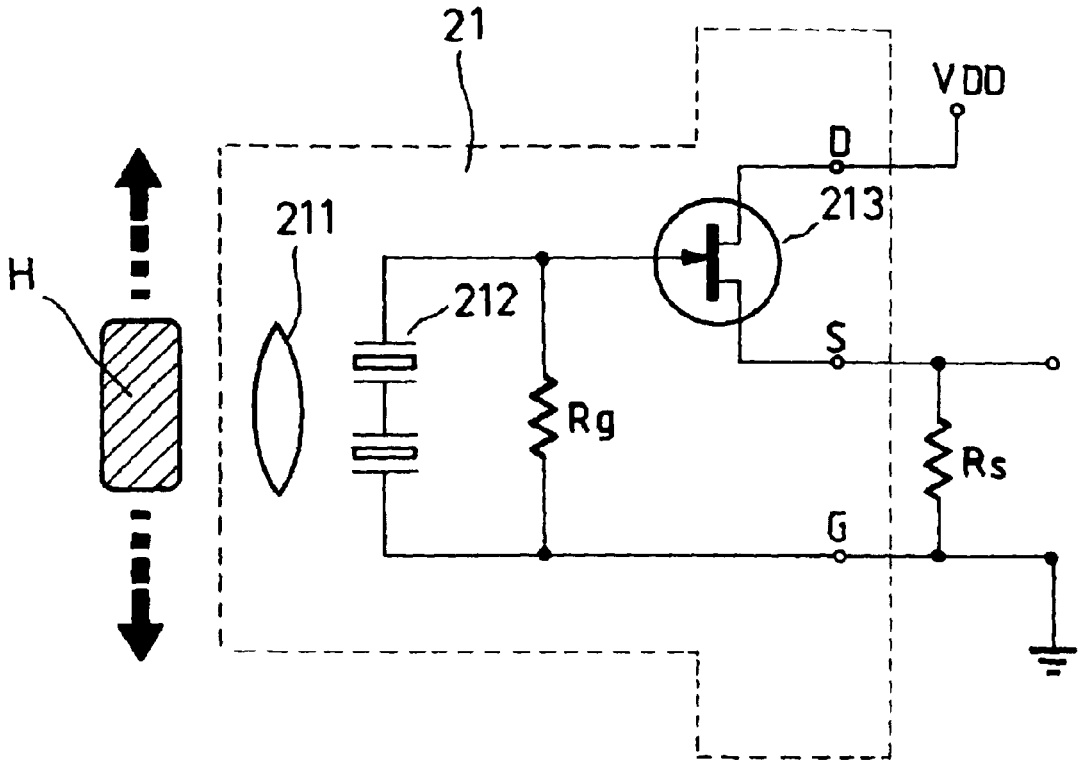
FIG. 6 is a circuit diagram of the pyroelectric effect sensor according to the present invention.

Referring to FIG. 6, the pyroelectric effect sensor 21 is comprised of a lens 211, a pyroelectric circuit board 212, and a FET (field effect transistor 213. When the user's hand H is moving over the pyroelectric effect sensor 21, the temperature change and movement is focused onto the pyroelectric circuit board 212 by the lens 211, producing a charge variation and transfer, that causes a resistor Rg to output a voltage to the FET 213, which amplifies the voltage signal and then produces a corresponding signal output through the S pole. Therefore, a voltage change is produced only when the heat source (body temperature) is moved over the sensor. It is more convenient to control the speed of the treadmill by means of moving the hand according to the present invention. Further, this control method is free from the interference of ambient light. Therefore, the body temperature actuated treadmill operation mode control arrangement of the present invention is highly reliable.

Referring to FIG. 4 again, the detection angle (θ) or distance of the body temperature movement detection circuit 2L/2R can be pre-set, preventing the production of false signal upon movement of a person who passes by.

As indicated above, the control circuit 5 is coupled to the console 13. Before exercise, the user can operate the console 13 to set the desired speed. After setting, the user can move the left hand or right hand over the body temperature movement detection circuit 2L or 2R to regulate the speed when exercising.

Figure 3:
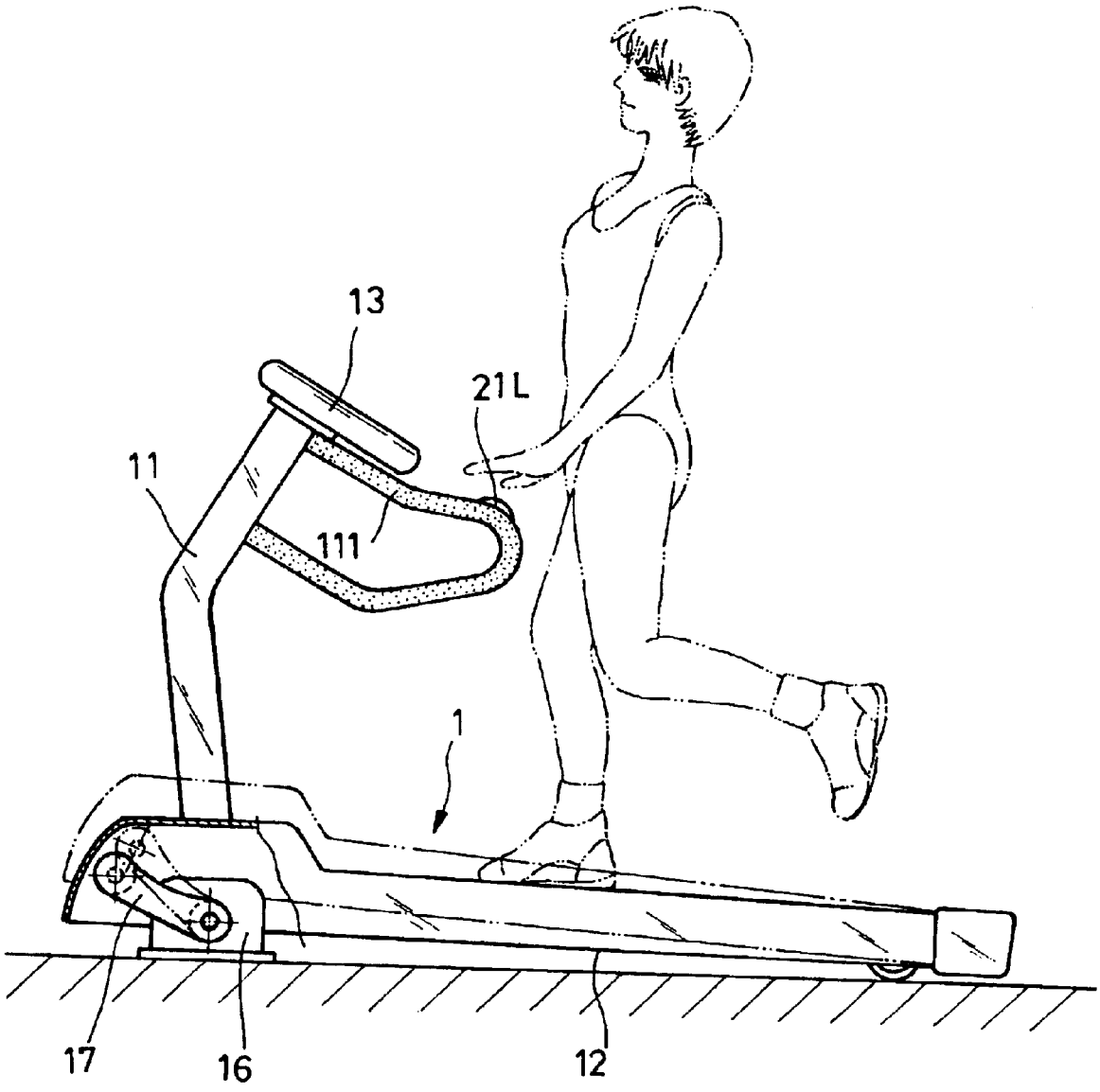
FIG. 3 is a schematic drawing showing a tread base tilting angle adjustment example according to the present invention.
Figure 4:
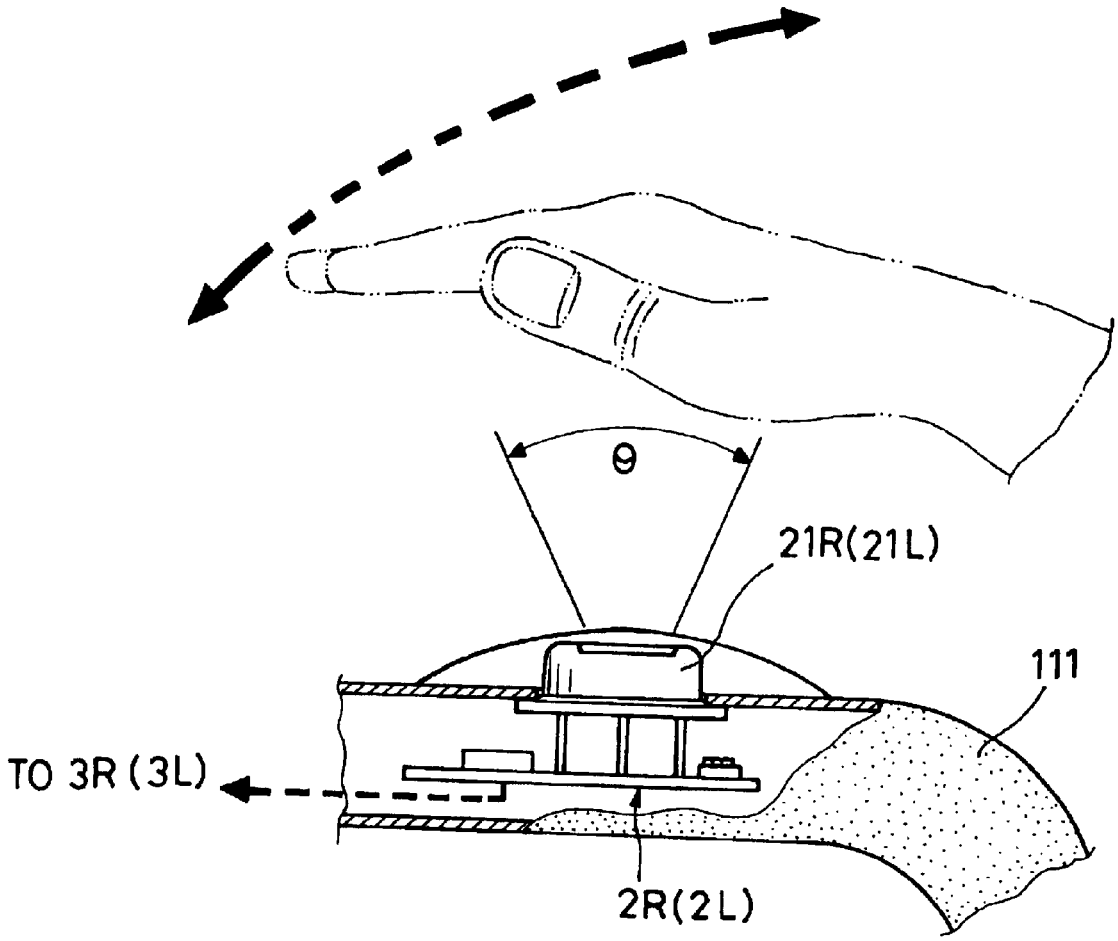
FIG. 4 is a schematic drawing showing the detection of the body temperature movement detection circuit according to the present invention.
Figure 5:
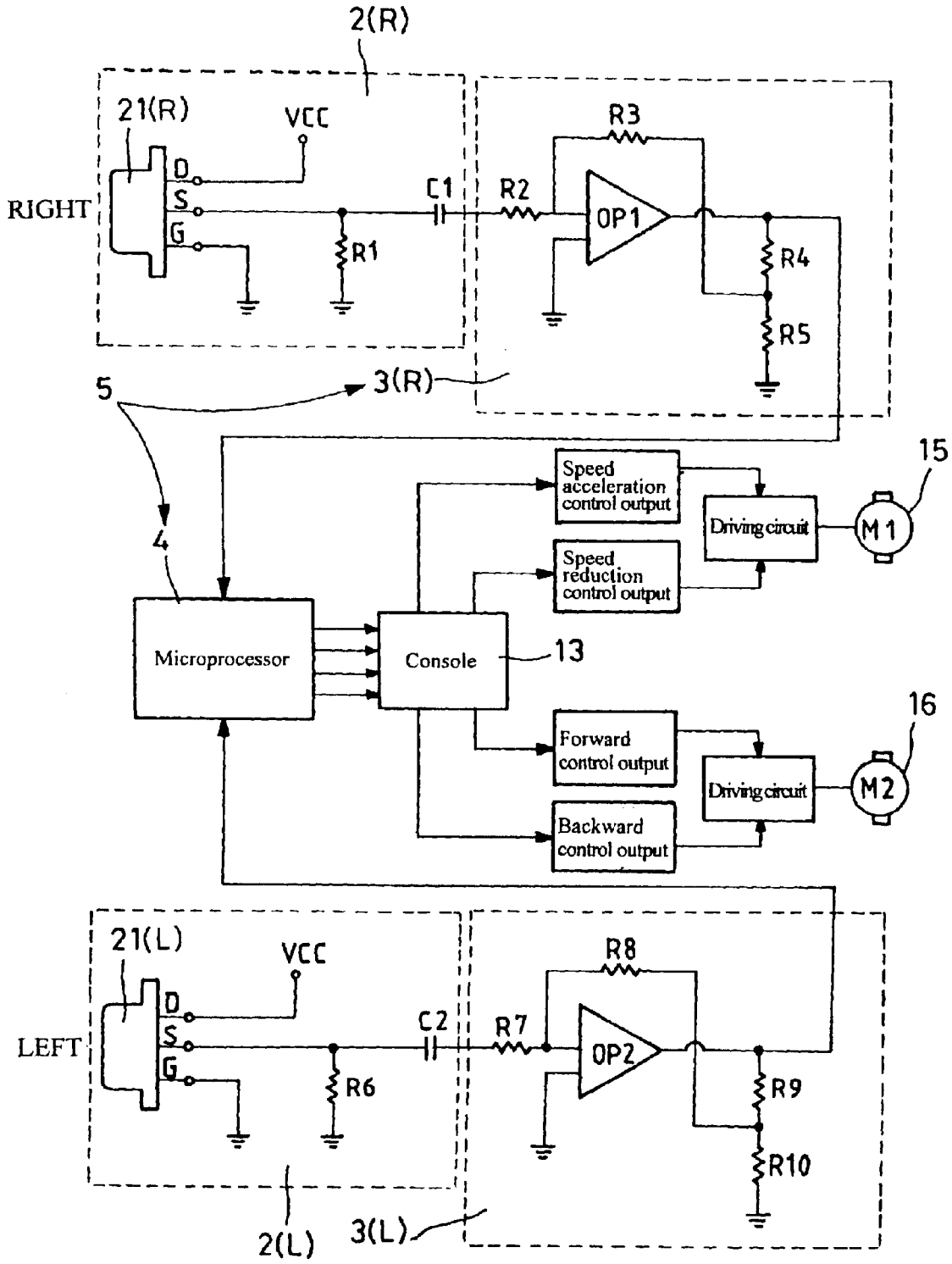
FIG. 5 is a circuit block diagram of the present invention.

Referring to FIGS. 3~5 again, a transmission mechanism 17 and a tilting control motor 16 are installed at the tread base 12, and controlled to adjust the tilting angle of the tread base 12. The body temperature movement detection circuits 2L and 2R can be set to control the forward/backward rotation of the tilting control motor 16, causing the tilting control motor 16 to adjust the tilting angle of the tread base 12.

Further, the body temperature movement detection circuits 2L and 2R can also be used to simultaneously control the speed of rotation of the walking belt and the tilting angle of the tread base. Subject to the distance or the moving hand or the time in which the moving hand is within the detection range, the microprocessor 4 accurately adjust the output status of the walking belt control motor or the tilting control motor.

A prototype of body temperature actuated treadmill operation mode control arrangement has been constructed with the features of FIGS. 1~5. The body temperature actuated treadmill operation mode control arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A body temperature actuated treadmill operation mode control arrangement used in a treadmill having a motor disposed at the bottom end of an upright frame to drive a walking belt in rotation, left and right handlebars disposed at the upright frame; and a console located on the top of the upright frame and used to control the treadmill's operation and to show numerical values and drawings with respect to the exercise state, the body temperature actuated treadmill operation mode control arrangement comprising:

a left body temperature movement detection circuit adapted to detect movement of the user's left hand to produce a corresponding signal output, said left body temperature movement detection circuit being formed of a left pyroelectric effect sensor, a resistor, and a capacitor, said left pyroelectric effect sensor being installed at the respectively disposed at the left handlebar of said treadmill;

a right body temperature movement detection circuit adapted to detect movement of the user's right hand to produce a corresponding signal output, said right body temperature movement detection circuit being formed of a right pyroelectric effect sensor, a resistor, and a capacitor, said right pyroelectric effect sensor being installed at the respectively disposed at the right handlebar of said treadmill;

signal amplifier means adapted to amplify the output signal of said left body temperature movement detection circuit and the output signal of said right body temperature movement detection circuit; and a microprocessor electrically coupled between said signal amplifier means and said console of said treadmill and adapted to control the operation speed of the motor of said treadmill subject to the output signal from said right body temperature movement detection circuit and the output signal from said left body temperature movement detection circuit.

2. A body temperature actuated treadmill operation mode control arrangement used in a treadmill having a reversible motor disposed at the bottom end of an upright frame to tilt a tread base, and a console located on the top of the upright frame and used to control the treadmill's operation and to show numerical values and drawings with respect to the exercise state, the body temperature actuated treadmill operation mode control arrangement comprising:

a left body temperature movement detection circuit adapted to detect movement of the user's left hand to produce a corresponding signal output, said left body temperature movement detection circuit being formed of a left pyroelectric effect sensor, a resistor, and a capacitor, said left pyroelectric effect sensor being installed at the respectively disposed at the left handlebar of said treadmill;

a right body temperature movement detection circuit adapted to detect movement of the user's right hand to produce a corresponding signal output, said right body temperature movement detection circuit being formed of a right pyroelectric effect sensor, a resistor, and a capacitor, said right pyroelectric effect sensor being installed at the respectively disposed at the right handlebar of said treadmill;

signal amplifier means adapted to amplify the output signal of said left body temperature movement detection circuit and the output signal of said right body temperature movement detection circuit; and a microprocessor electrically coupled between said signal amplifier means and said console of said treadmill and adapted to control the forward/backward rotation of the reversible motor of said treadmill subject to the output signal from said right body temperature movement detection circuit and the output signal from said left body temperature movement detection circuit.

3. A body temperature actuated treadmill operation mode control arrangement used in a treadmill having a walking belt control motor and a tilting control motor respectively disposed at the bottom end of an upright frame to drive a walking belt in rotation and to tilt a tread base carrying the walking belt, and a console located on the top of the upright frame and used to control the treadmill's operation and to show numerical values and drawings with respect to the exercise state, the body temperature actuated treadmill operation mode control arrangement comprising a left body temperature movement detection circuit adapted to detect movement of the user's left hand to produce a corresponding signal output, said left body temperature movement detection circuit being formed of a left pyroelectric effect sensor, a resistor, and a capacitor, said left pyroelectric effect sensor being installed at the respectively disposed at the left handlebar of said treadmill;

a right body temperature movement detection circuit adapted to detect movement of the user's right hand to produce a corresponding signal output, said right body temperature movement detection circuit being formed of a right pyroelectric effect sensor, a resistor, and a capacitor, said right pyroelectric effect sensor being installed at the respectively disposed at the right handlebar of said treadmill;

signal amplifier means adapted to amplify the output signal of said left body temperature movement detection circuit and the output signal of said right body temperature movement detection circuit; and a microprocessor electrically coupled between said signal amplifier means and said console of said treadmill and adapted to control the speed of said walking belt control motor and forward/backward rotation of said tilting control motor subject to the output signal from said right body temperature movement detection circuit and the output signal from said left body temperature movement detection circuit.

* * * * *